US009759464B2

(12) United States Patent
Sanhaji

(10) Patent No.: US 9,759,464 B2
(45) Date of Patent: Sep. 12, 2017

(54) APPARATUS AND METHOD FOR RECOVERING AND REGENERATING A REFRIGERANT FROM AN A/C PLANT

(71) Applicant: ECOTECHNICS S.P.A., Sesto Fiorentino (IT)

(72) Inventor: Rahhali Sanhaji, Sesto Fiorentino (IT)

(73) Assignee: SNAP-ON CLIMATE SOLUTIONS S.R.L., Correggio (IT)

( * ) Notice: Subject to any disclaimer, the term of this patent is extended or adjusted under 35 U.S.C. 154(b) by 231 days.

(21) Appl. No.: 14/404,580

(22) PCT Filed: May 29, 2013

(86) PCT No.: PCT/IB2013/054443

§ 371 (c)(1),
(2) Date: Nov. 28, 2014

(87) PCT Pub. No.: WO2013/179241

PCT Pub. Date: Dec. 5, 2013

(65) Prior Publication Data

US 2015/0107279 A1 Apr. 23, 2015

(30) Foreign Application Priority Data

May 30, 2012 (IT) ..... PI2012A0066
May 31, 2012 (IT) ..... PI2012A0067

(51) Int. Cl.
*F25B 43/04* (2006.01)
*F25B 45/00* (2006.01)

(52) U.S. Cl.
CPC ..... *F25B 43/043* (2013.01); *F25B 45/00* (2013.01)

(58) Field of Classification Search
CPC ..... F25B 43/043
See application file for complete search history.

(56) References Cited

U.S. PATENT DOCUMENTS 4,285,206 A * 8/1981 Koser ..... B60H 1/00585 62/126
4,805,416 A * 2/1989 Manz ..... F25B 45/00 62/292

(Continued)

OTHER PUBLICATIONS

International Search Report mailed Jan. 17, 2014, corresponding to International Patent Application PCT/IB2013/054443.

*Primary Examiner* — Emmanuel Duke
(74) *Attorney, Agent, or Firm* — Ladas & Parry LLP

(57) ABSTRACT

An apparatus for recovering refrigerant from an air conditioning system includes an evaporator arranged to receive the refrigerant from the air conditioning system and to separate it from impurities present in it, obtaining purified refrigerant, a compressor for circulating the purified refrigerant, a condenser, and a storage container arranged to contain the condensed refrigerant. The storage container defines a storage chamber arranged to contain a liquid phase of the refrigerant and a gaseous phase including a vapor component of the refrigerant and an air component. The apparatus also includes a measuring means configured to measure operating parameters of the refrigerant present in the storage chamber, purge device arranged at a purge opening configured to purge the gaseous phase present in the storage chamber responsive to the operating parameters, and at least one first separation chamber connected to the storage container.

21 Claims, 10 Drawing Sheets

(56) References Cited

U.S. PATENT DOCUMENTS

| | | | | | |
|---|---|---|---|---|---|
| 5,146,761 | A * | 9/1992 | Cavanaugh | F25B 45/00 | 62/149 |
| 5,172,562 | A * | 12/1992 | Manz | F25B 45/00 | 62/149 |
| 5,247,802 | A * | 9/1993 | Maniez | F25B 45/00 | 62/149 |
| 5,247,804 | A * | 9/1993 | Paige | F25B 45/00 | 62/126 |
| 5,359,859 | A * | 11/1994 | Bench | F25B 45/00 | 62/292 |
| 6,591,629 | B1 * | 7/2003 | Galbreath, Jr. | F25B 45/00 | 62/149 |
| 2007/0006609 | A1 | 1/2007 | Thomas et al. | | |
| 2007/0101759 | A1 | 5/2007 | Matsuoka et al. | | |
| 2007/0113581 | A1 | 5/2007 | Yoshimi et al. | | |

* cited by examiner

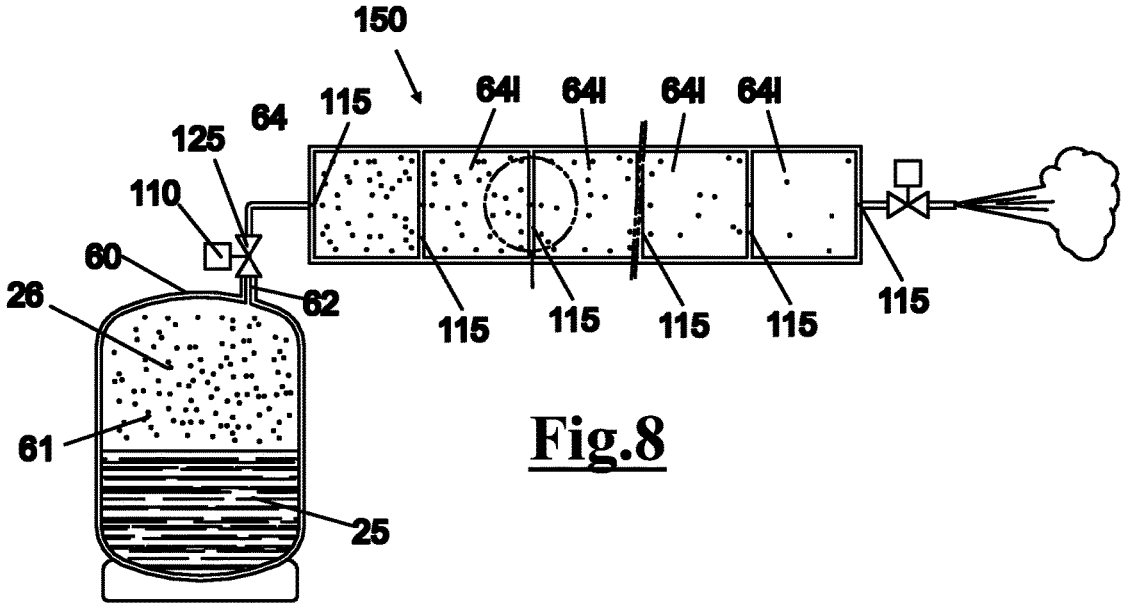
Fig.8
Fig.8B
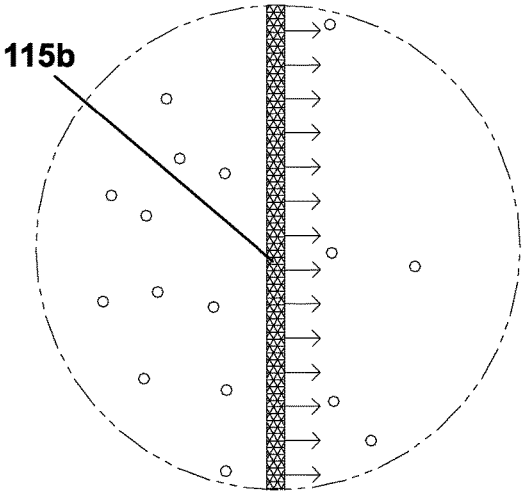
Fig.8A
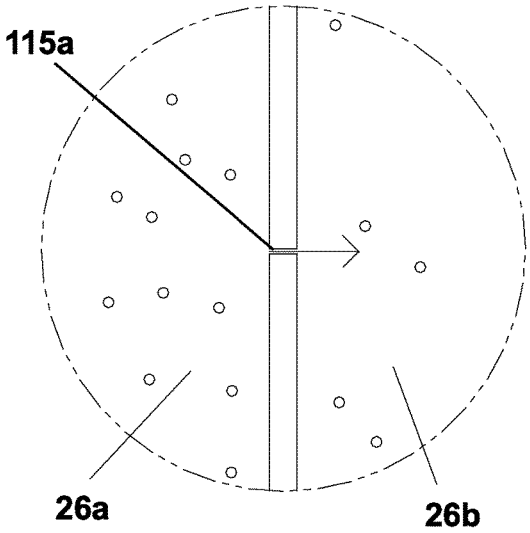

```
Start: refilling A/C plant by 243a valve
If mass < 345 g
Then continue refilling by 243a valve
If mass > 345 g
Then stop refilling by 243a valve and start refilling by 243b valve
```

APPARATUS AND METHOD FOR RECOVERING AND REGENERATING A REFRIGERANT FROM AN A/C PLANT

FIELD OF THE INVENTION

The present invention relates to a method to purge air from a refrigerant in a recovery and depuration apparatus, which is applied for example to an air conditioning system of a car.

Furthermore, the invention relates to an apparatus that implements said method.

BACKGROUND OF THE INVENTION

As well known, the refrigerant present in air conditioning systems, in particular those on board of vehicles such as cars, is periodically recovered and recycled for eliminating the impurities accumulated during the operation cycle. To this purpose, the refrigerant is purged from the air conditioning system by a recovery and regeneration apparatus as described in EP1367343A1.

In these types of machines the refrigerant is subjected to a regeneration cycle in which it is depurated of the impurities in it present. Air is one of these impurities that has to be purged.

Presently, the elimination of air, in machines like EP1367343A1, is done by opening purge valves at the top of containers present in the recovery and regeneration circuit. In fact, air, like any other non-condensable gas, is accumulated in the highest parts of the containers and then the opening of purge valves makes it possible to discharge it outside. The purging step has, however, the drawback of causing unavoidably the loss of refrigerant in vapour phase, which is dragged out with air. Occasionally, the lost amount can be higher than the limit allowed by regulations.

Considering that such treatment is carried out on a very high number of air conditioning systems per day, it can be understood that this produces a high accumulation of the refrigerant in the environment, causing environmental damages. Furthermore, the cumulated discharge of refrigerant leads to not negligible economical damages due to the refrigerant cost, which is remarkably grown with a new type of refrigerant, called HFO 1234yf. The discharge in the environment of refrigerant causes also safety problems, since the refrigerant HFO 1234yf is highly inflammable, and an excessive cumulated discharge in the environment can generate an atmosphere that can explode or burn causing very serious damages to things or people.

Normally, air and other non-condensable gases are purged from the storage reservoir of the regenerated refrigerant. A first type of known purging devices provides a mechanism consisting of a manual valve, which is mounted directly to the storage container of the regenerated refrigerant of existing recovery and depuration machines, assisted by a manometer and by a temperature sensor.

After checking the pressure and temperature values of the storage container with those from tables relative to the pure gas, the valve is opened for purging air present in the refrigerant directly into the environment. The purge operation proceeds, until the pressure reaches the equilibrium vapour pressure. By purging air this way, it is apparent that the loss of refrigerant cannot be controlled, owing to the discharge of the vapour entrained with air in the gaseous phase of the storage container.

A second type of known purging devices provides a mechanism consisting of a solenoid valve mounted directly to the storage container the of the refrigerant, operated by a pressure transducer and by a temperature sensor.

Once measured the temperature, the corresponding pressure is determined using the equation of state of the pure refrigerant: if the pressure transducer detects a pressure higher than the reference pressure, the microprocessor is enabled to open the solenoid valve for purging air present in the refrigerant directly into the environment. The solenoid valve blocks automatically when the pressure reaches the equilibrium vapour pressure. A second control is carried out closing the solenoid valve when a threshold weight loss ratio of the recycled refrigerant is reached. In a third method the solenoid valve is closed after checking both the values of equilibrium vapour pressure and of weight loss ratio of the depurated refrigerant.

A third type of known purging device provides a mechanism consisting of a solenoid valve mounted directly to the storage container of the refrigerant, assisted by a pressure transducer for measuring the pressure of the storage container and by a pressure transducer connected to a bulb, filled with a pure refrigerant of the same type, in contact with the container and insulated from the outer environment. Alternatively, such device can provide positioning the bulb with the pure reference gas directly in the storage container.

The use of a pressure transducer with a bulb filled with pure gas and thermally coupled to the storage reservoir allows measuring directly the vapour pressure. This way, the device can trigger the solenoid valve after checking directly the difference between the vapour pressure of the pure gas and the pressure of the container.

The methods described above have the drawbacks of discharging amounts of vapour of the refrigerant entrained with air. If an attempt is made to reduce the loss of refrigerant, for example by stopping the discharge with a control on the loss by weight of the refrigerant, there is the opposite drawback to purge not completely the air present in the refrigerant.

Refrigerating systems also exist, for example of the type described in EP1681523, where a porous membrane is provided through which a flow is conveyed comprising the vapour phase of the refrigerant and the non-condensable gases, in such a way that the membrane blocks the passage of refrigerant, leaving only the non-condensable gases to pass.

However, this solution, can be acceptable for a refrigerating system, but cannot be used in a refrigerant regeneration system, since it would not ensure a suitable purification of the refrigerant without having waste of the same and polluting the environment.

SUMMARY OF THE INVENTION

It is then a feature of the present invention to provide a device capable of purging air present in the regenerated refrigerant in a precise way, limiting to the minimum the loss of refrigerant and improving in the meantime the degree of purity of the regenerated refrigerant, in order to meet the regulations currently in force, which define a more restrictive degree of purity and maximum admissible loss of refrigerant into the environment.

It is also a feature of the present invention to provide this device which can be mounted as retrofit to a refrigerant recovery and regeneration apparatus for executing cycles of recovering, regenerating, vacuuming and re-filling the refrigerant automatically, like those existing for A/C systems for cars.

These and other objects are achieved by an apparatus for recovering and regenerating a refrigerant from an air conditioning system, said apparatus comprising:

an evaporator arranged to receive the refrigerant from a conditioning system and to separate it from impurities in it present, obtaining purified refrigerant;

a compressor arranged to circulate the purified refrigerant exiting from the evaporator;

a condenser in hydraulic connection with the compressor, and arranged to condense the refrigerant exiting from the compressor;

a storage container in hydraulic connection with the condenser, and arranged to contain the refrigerant condensed by the condenser, said storage container defining a storage chamber arranged to contain a liquid phase of the refrigerant and a gaseous phase which includes a vapour component of the refrigerant and an air component, and having a purge opening;

wherein the apparatus is also comprised of a purging device comprising:

a measuring means configured to measure operating parameters of the refrigerant present in the storage chamber;

a purge means arranged at the purge opening configured to purge the gaseous phase present in the storage chamber responsive to the operating parameters determined by the measuring means;

at least a first separation chamber connected to the storage container;

a selective passage means arranged at the connection between said storage chamber and the first separation chamber, said selective passage means arranged to separate the gaseous phase into a vapour component of refrigerant and an air component in such a way that only the air component and a reduced amount of the vapour component enter the first separation chamber.

In particular, the selective passage means is arranged to divide the gaseous phase respectively into the vapour component of fluid and in the air component according to the Graham law, which defines that the effusion rate of two different gases are inversely proportional to the square roots of their molecular masses:

$$u1/u2=\sqrt{Mm(2)}/\sqrt{Mm(1)}$$

Effusion is the process, governed by the above described equation, by means of which the gas molecules cross a thin calibrated hole from a container to another container where the pressure is lower. In particular, for a mixture of air (Mm(air)=28, 84 g/mol) and HFO1234yf (Mm(HFO1234yf) =114, 06=g/mol) it is obtained that the speed of air effusion is about double than the refrigerant; this makes it possible to exploit in an effective way the effusion for purging more air than vapour of refrigerant.

In particular, for a mixture of air and refrigerant gas R-134a that has a molar mass of 102.03 g/mol a speed of air effusion is obtained 1.88 times higher than the gas.

Advantageously, the selective passage means comprises a dividing wall with a calibrated hole.

Alternatively the selective passage means comprises a porous dividing wall.

Advantageously, a plurality of separation chambers is provided adjacent to each other and separated by said selective passage means. This way, using one or more chambers in series at progressively lower pressures connected by holes of small diameter or alternatively, by porous dividing walls, with effusion of the mixture through the chambers and then purge from the last chamber of the air mixture into the environment, it is possible to obtain an ideal purging of sole air. This technique can be applied to any mixture of gas with the variable that this process is the more effective the more the molecular masses of the two gas are different from each other.

In particular, a duct is provided that connects the storage container to the evaporator, in such a way that the first separation chamber is the evaporator, in such a way that the gaseous phase, comprising the vapour component of the refrigerant and the air component, flows from the storage container to the evaporator, through a first selective passage means at the storage container and a second selective passage means arranged at the exit from the evaporator for being then purged into the environment.

Advantageously, at the duct that connects the storage container with the evaporator a third selective passage means is arranged at the inlet of the duct in the evaporator, in such a way that the duct defines a further separation chamber. In this case, the connection duct, equipped with the means for separation exiting from the storage chamber and at the entrance of the evaporator, works as further separation chamber in which a further selection is carried out of the air component with respect to the vapour component.

Advantageously, the measuring means comprises a thermometer and a pressure switch. In particular, the pressure switch is a differential pressure switch connected to the storage reservoir and to a bulb of pure refrigerant thermally coupled to the reservoir. With such thermometer and pressure switch, the purge of air can be carried out automatically responsive to a signal from the differential pressure switch until it reaches the selected pressure that is given by a value $\Delta P$ added to the vapour pressure measured in the reference bulb.

Preferably, the purge means comprises a valve associated with the measuring means and configured to purge the air component when predetermined operating threshold values of the parameters of the refrigerant are exceeded.

According to a further aspect of the invention, a method for recovering refrigerant from an air conditioning system comprises the steps of:

collecting the refrigerant from the air conditioning system, and separating by evaporation the refrigerant from impurities in it present, obtaining purified refrigerant, said step of collecting and separating carried out by an evaporator;

compressing the purified refrigerant exiting from the evaporator, said compressing step carried out by a compressor;

condensing the refrigerant exiting from the compressing step, said condensing step carried out by a condenser;

accumulating the refrigerant condensed by a condenser into a storage container in hydraulic connection with the condenser same;

wherein the further steps are comprised of:

prearranging at least one separation chamber connected to the storage container, and a selective passage means arranged to put in connection the storage container and the first separation chamber;

separating a gaseous phase vapour component a of fluid and an air component b, in such a way that only the air component b and a reduced amount of vapour component a move through the selective passage means and reach the first separation chamber.

Advantageously, the apparatus comprises furthermore:

a collector arranged to hydraulically connect, by two connection ducts, a high pressure duct and a low pressure duct of the air conditioning system with a feed duct for feeding the fluid into the apparatus;

a first charging duct having a first valve configured to be switched between an open position, for connecting hydraulically the storage container to the air conditioning system and then sending the regenerated refrigerant in liquid phase from the storage container to the air conditioning system, and a closed position, to insulate hydraulically the storage container from the air conditioning system;

a measuring means configured to measure the amount of refrigerant contained in the storage container obtaining a determined amount of fluid discharged from the storage container and charged into the air conditioning system;

a second charging duct, arranged parallel to the first charging duct, which is adapted to send the refrigerant in gaseous phase to the air conditioning system.

In particular, the second charging duct is located downstream of the storage container and parallel to the first charging duct, and is adapted to send the regenerated refrigerant in gaseous phase from the storage container to the air conditioning system.

Advantageously, the second charging duct has a second valve configured to be switched between an open position, for connecting hydraulically the storage container to the air conditioning system and then sending the regenerated refrigerant in gaseous phase from the storage container to the air conditioning system, and a closed position, to insulate hydraulically the storage container from the air conditioning system;

In particular, a means is provided for arranging selectively and alternatively the first and the second valve to the open position and to the closed position depending on whether the value of the amount indicated by the measuring means is lower, or higher, than a predetermined minimum threshold value proximate to, and less than, a predetermined charging amount.

Advantageously, the first charging duct provides a suction mouth close to the bottom of the storage container, in order to ensure a suction of the sole liquid phase of the refrigerant, and the second charging duct provides a discharge mouth from the storage container, in a top position of the storage container, in order to ensure a suction of the sole gaseous phase of the refrigerant.

In particular, the second charging duct provides a means for converting into gaseous phase the refrigerant that is stored in liquid phase.

Advantageously, the second charging duct provides a means for pumping refrigerant in gaseous phase.

According to another aspect of the invention, an apparatus for recovering refrigerant from an air conditioning system comprises:

a collector arranged to hydraulically connect, by two connection ducts, a high pressure duct and a low pressure duct of the air conditioning system with a feed duct for feeding the fluid into the apparatus;

an evaporator arranged to separate the refrigerant from impurities in it present through an evaporation of residue liquid fractions of the refrigerant obtaining a purified refrigerant that rises again to the high part of the evaporator and of impurities that are concentrated at the bottom of the evaporator;

a compressor arranged to circulate the purified refrigerant exiting from the evaporator, said compressor being in hydraulic connection with the feed duct through the evaporator;

a condenser in hydraulic connection with the compressor, said condenser arranged to cool and condense the refrigerant exiting from the compressor;

a storage container in hydraulic connection with the condenser, said storage container arranged to contain the refrigerant condensed by the condenser;

a first charging duct having a first valve configured to be switched between an open position, for connecting hydraulically the storage container to the air conditioning system and then sending the regenerated refrigerant in liquid phase from the storage container to the air conditioning system, and a closed position, to insulate hydraulically said storage container and the air conditioning system;

a measuring means configured to measure the amount of refrigerant contained in the storage container obtaining a determined amount of fluid discharged from said storage container and charged into said air conditioning system;

wherein a second charging duct is provided, arranged parallel to the first charging duct, which is adapted to send the refrigerant in gaseous phase to the air conditioning system.

This way, when charging the air conditioning system, it is possible to transfer the refrigerant in liquid phase until it reaches said predetermined minimum threshold value. Beyond said value, it is possible to stop charging the refrigerant in liquid phase and to let a small amount of refrigerant in gaseous phase to flow towards the collector and the connection ducts, in such a way that the gas entrains the refrigerant in liquid phase remained in the connection ducts between the recovery and regeneration apparatus and the air conditioning system, pushing it completely into the air conditioning system. So, it is assured that all the refrigerant that has left the storage container, and that has been measured reading the loss of weight of the storage container, except from liquid and gaseous fractions that can be determined, has reached the air conditioning system. In other words, this particular technical solution allows testing and correlating the amount of refrigerant in liquid phase released by the reservoir to that present in the air conditioning system, having completely removed the refrigerant in liquid phase present in the connection ducts.

Advantageously, the second charging duct is located downstream of the storage container and parallel to the first charging duct, and is adapted to send the regenerated refrigerant in gaseous phase from the storage container to the air conditioning system.

This way, the refrigerant in gaseous phase that is present in the high part of the storage container is exploited.

More in particular, the apparatus can be arranged in such a way that:

the second charging duct has a second valve configured to be switched between an open position, for connecting hydraulically the storage container to the air conditioning system and then sending the regenerated refrigerant in gaseous phase from the storage container to the air conditioning system, and a closed position, to insulate hydraulically said storage container and the air conditioning system;

a means is provided for arranging selectively and alternatively the first and the second valve to the open position and to the closed position depending on whether the value of the amount indicated by the measuring means is lower, or higher, than a predetermined minimum threshold value proximate to, and less than, a predetermined charging amount.

This solution provides the step of charging in liquid phase and then gaseous phase, automatically. In fact, in a computer-operated way, when charging the air conditioning system, it is possible to open the first valve and conveying the refrigerant in liquid phase until it reaches said predetermined minimum threshold value. Beyond said value, it is possible to stop the first valve and open the second valve, allowing a small amount of refrigerant in gaseous phase to apply the pressure necessary to the introduction in the air conditioning system of all the refrigerant in liquid phase remained in the connection ducts between the recovery and regeneration apparatus and the air conditioning system.

Advantageously, the first charging duct can provide a suction mouth close to the bottom of the storage container, in order to ensure a suction of the sole liquid phase of the refrigerant, and said second charging duct can provide a discharge mouth from said storage container in a top position of said storage container, in order to ensure a suction of the sole gaseous phase of the refrigerant. The position of the suction mouth and the discharge mouth of the gaseous phase ensures that there are not accidental flows of gas in the duct for the liquid or of liquid in the duct for the gas.

Advantageously, the second charging duct can provide a means for converting into gaseous phase the refrigerant that is stored in liquid phase. Such solution provides an auto-production of gaseous refrigerant from the liquid, for example by means of heating.

In particular, the second charging duct can provide a means for pumping refrigerant in gaseous phase from a reservoir. Even this alternative solution provides re-feeding refrigerant in gaseous phase, for avoiding the above described drawbacks.

BRIEF DESCRIPTION OF THE DRAWINGS

The invention will be now shown with the following description of an exemplary embodiment thereof, exemplifying but not limitative, with reference to the attached drawings in which:

FIG. 8 shows another exemplary embodiment of the purging device of FIG. 6 with multiple separation chamber;

FIGS. 8A and 8B show two possible embodiments of a selective passage means;

DESCRIPTION OF EXEMPLARY EMBODIMENTS EXEMPLARY

Figure 1:
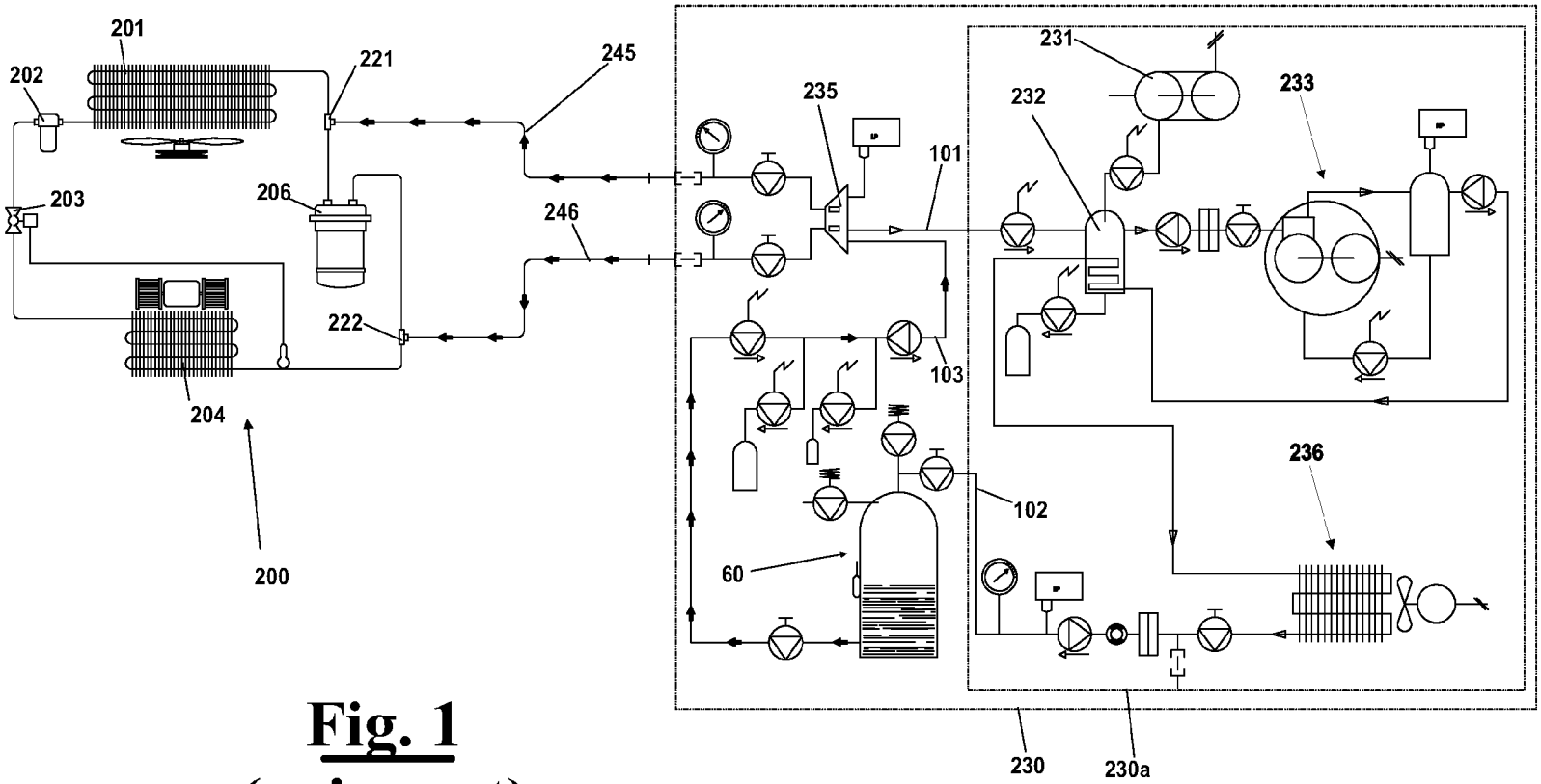
Fig. 1 (prior art)
FIG. 1 shows a circuit of a recovery and regeneration apparatus according to the prior art.

With reference to FIG. 1, an apparatus 230 is shown, according to the prior art, which is adapted to recover the refrigerant from an air conditioning system 200 by connection means as flexible ducts 245, 246 respectively connected to high pressure connector 221 and low pressure connector 222 of the air conditioning system 200. The latter comprises, as well known, a condenser 201, a filter 202, a calibrated hole 203, an evaporator 204, a storage container 205 and a compressor 206. The operation of recovering the refrigerant, through the ducts 245 and 246, is carried out mainly in liquid phase by the high pressure connector 221 and in gaseous phase by the low pressure connector 222.

Owing to the work of machine 230, the refrigerant by suction through ducts 245 and 246 reaches, via a collector 235 and a feeding duct 101, a purification unit 230*a*, comprising an evaporator 232, a compressor 233 and a condenser 236. Then, the refrigerant condensed and purified after the regeneration process is accumulated, by the feed duct 102, into a storage reservoir 60. Finally, after vacuuming the plant 200, by vacuum pump 231, the refrigerant is refilled into the plant through the duct 103, the collector 235 and the flexible connection ducts 245 and 246.

Figure 2:
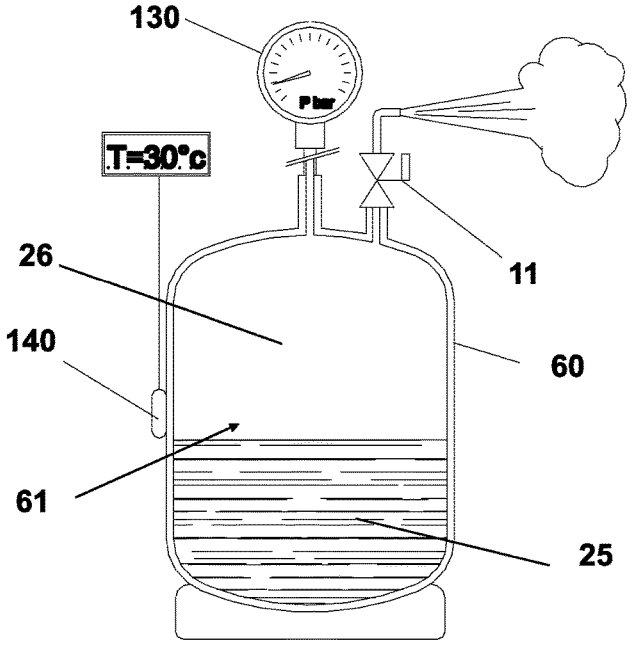
Fig.2 (prior art)
FIG. 2 shows a diagrammatical view of a possible solution, according to the prior art, for measuring and purging air and gas impurities present in a storage container in a refrigerant recovery and regeneration apparatus.

With reference to FIG. 2, a prior art device to purge air provides a mechanism consisting of a manual valve 11 mounted directly to the storage container 60 of the regenerated refrigerant in the recovery and depuration machine, by a manometer 130 and by a temperature sensor 140. In particular, the storage container 60 defines a storage chamber 61 arranged to contain a liquid phase 25 of the refrigerant and a gaseous phase 26.

After checking the pressure and temperature values of the storage container 60 with those taken from tables relative to the pure gas, the manual valve 11 is manually switched on and off for purging air present in the refrigerant directly into the environment. The purging operation is continued until the pressure reaches the equilibrium vapour pressure. By purging air this way, it is apparent that an excessive loss of refrigerant, owing to entrainment of the vapour present in the gaseous phase of the storage container cannot be avoided.

Figure 3:
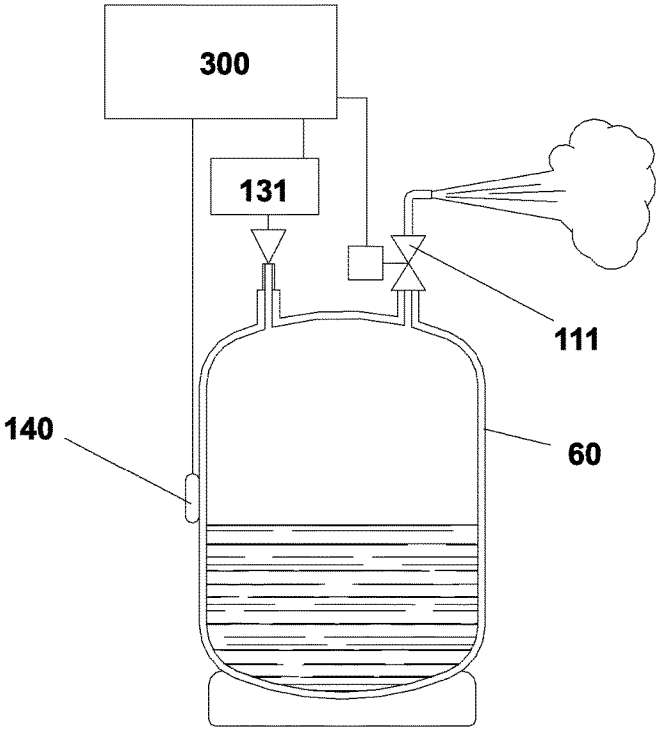
Fig.3 (prior art)
FIG. 3 shows a diagrammatical view of a second possible solution, according to the prior art, for measuring and purging air and gas impurities present in a storage container in a refrigerant recovery and regeneration apparatus.

With reference to FIG. 3, a second device to purge air provides a mechanism consisting of a solenoid valve 111 mounted directly to the storage container 60 of the refrigerant associated to a pressure transducer 131 and a temperature sensor 140.

Once determined the temperature, the corresponding pressure is determined using the equation of state of the pure refrigerant: if the pressure transducer 131 detects a pressure more than the reference pressure, a microprocessor 300 triggers solenoid valve 111 which opens for purging air present in the refrigerant directly into the environment. The solenoid valve 111 blocks automatically when the pressure reaches the equilibrium vapour pressure. A second control method provides closing the solenoid valve 111 in such a way to achieve a maximum predetermined loss of weight ratio of the recycled refrigerant. In a third method the solenoid valve 111 is blocked after checking both values of equilibrium vapour pressure and weight loss ratio of the depurated refrigerant.

Figure 4:
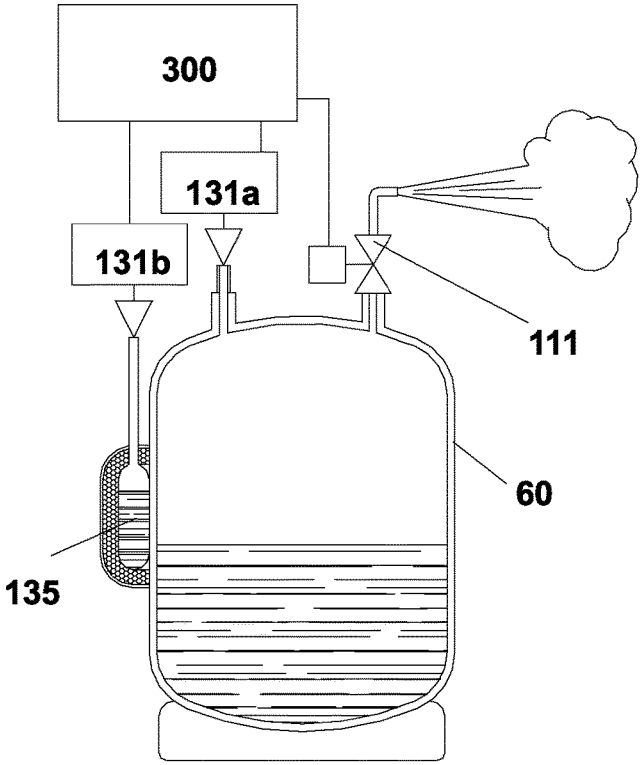
Fig.4 (prior art)
FIG. 4 shows a diagrammatical view of a third possible solution, according to the prior art, for measuring and purging air and gas impurities present in a refrigerant in a storage container in a refrigerant recovery and regeneration apparatus.

With reference to FIG. 4, a third device used to purge air provides a mechanism consisting of a solenoid valve 111 mounted directly to the storage container the refrigerant 60, by a pressure transducer for measuring the pressure of the storage container 131*a* and by a reference pressure transducer 131*b* connected to a bulb 135, filled with the same type of pure refrigerant, in contact with the container 60 and insulated from the outer environment.

Figure 5:
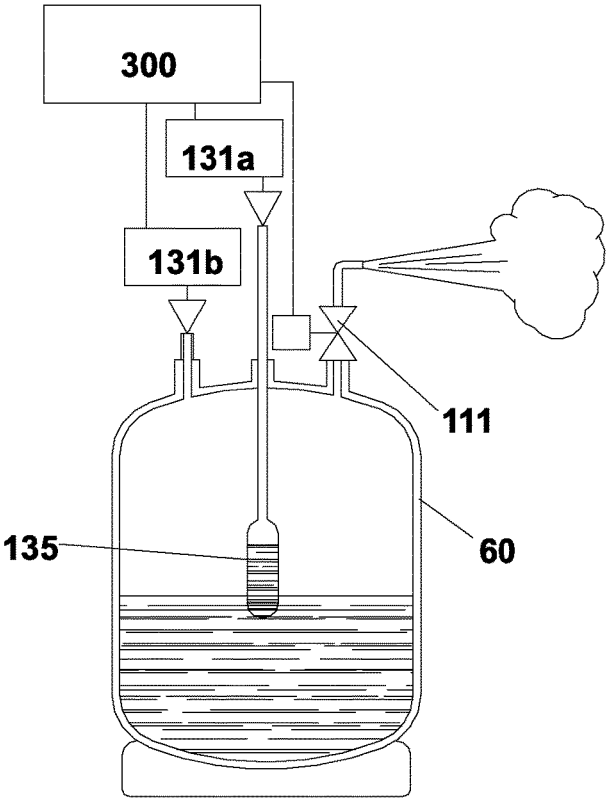
Fig.5 (prior art)
FIG. 5 shows a diagrammatical view of a fourth possible solution, according to the prior art, for measuring and purging air and gas impurities present in a storage container in a refrigerant recovery and regeneration apparatus.

With reference to FIG. 5, an alternative way to provide the device described with reference to FIG. 4, structurally the same, consists of positioning the bulb 135 with the pure reference gas directly in the storage container 60.

Figure 6:
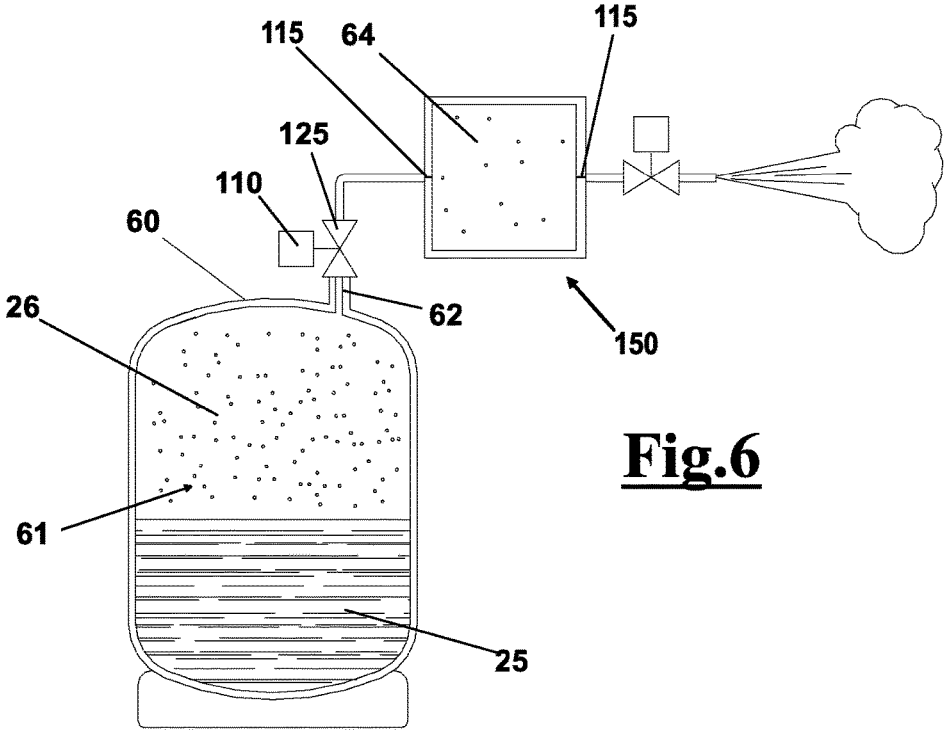
FIG. 6 shows a diagrammatical view of a first exemplary embodiment, according to the invention, of a device for purging air and gas impurities present in a storage container in a refrigerant recovery and regeneration apparatus.

With reference to FIG. 6, a device to purge air, according to the present invention, comprises, with respect to the prior art devices of FIGS. 2-5, a purging device 150, comprising a measuring means 110 configured to measure operating parameters of the refrigerant present in the storage chamber 61 and a purge means 125 arranged at a purge opening 62 configured to purge the gaseous phase 26 present in the storage chamber 61.

Advantageously, the measuring means 110 comprises a thermometer and a pressure switch. Preferably, the purge means 125 comprises a valve associated with the measuring means 110 and configured to purge the air component 26*b* upon reaching predetermined operating threshold values of the parameters of the refrigerant.

In more detail, the purging device 150 comprises a separation chamber 64, connected to the storage container 60, and a selective passage means 115 arranged substantially upstream of the opening 62, in particular between the storage chamber 61 and the chamber 64.

Figure 7:
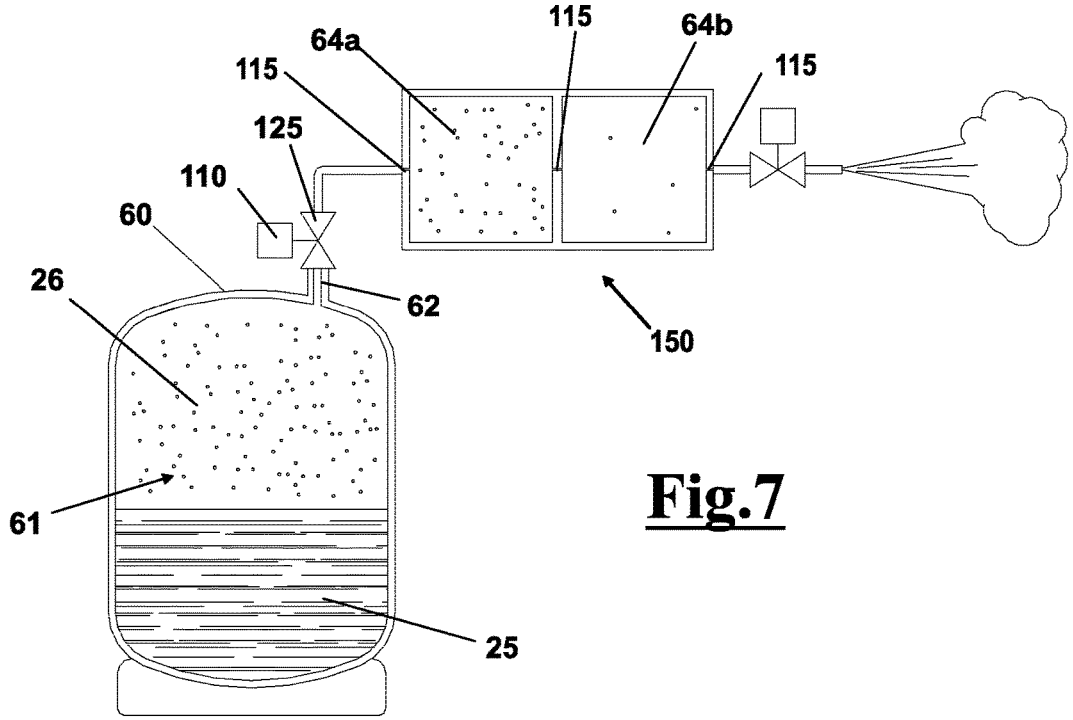
FIG. 7 shows an exemplary embodiment of the purging device of FIG. 6 with double separation chamber.

In a possible exemplary embodiment of the invention, as shown in FIG. 7, two separation chambers 64*a* and 64*b* adjacent to each other can also be provided, each divided from the next one by a wall and by a selective passage means 115. This way, it decreases the amount of vapour that comes to the purge valve with respect to the case of FIG. 6.

As shown in FIG. 8, a plurality of separation chambers 64*i* adjacent to each other can also be provided, each divided from the following by a wall and through a selective passage means 115. This way, it is increased further the selection between air and vapour of refrigerant and decreased further the amount of vapour that comes to the purge valve with respect to the case of FIGS. 6 and 7.

More In particular, with reference to FIG. 8A, the selective passage means 115 is adapted to separate the gaseous phase 26 into an vapour component 26*a* of fluid and an air component 26*b* in such a way that upstream of the selective passage means 115 is purged from the first separation chamber 64, or from the most upstream chamber 64*i*, only the air component 26*b* and a reduced amount of the vapour component 26*a*.

In particular, the selective passage means 115 comprises a dividing wall with a calibrated hole 115*a* arranged to divide the gaseous phase 26 respectively into the vapour component 26*a* of fluid and the air component 26*b* according to the Graham law, which defines that the effusion rate of two different gases are inversely proportional to the square roots of their molecular masses:

$$u1/u2=\sqrt{M_{m2}}/\sqrt{M_{m1}}$$

The principle of the effusion is the process by means of which the gaseous molecules cross a thin calibrated hole from a container to another where the pressure is lower, in a way governed by the above described equation. In particular, for a mixture of air $Mm_{air}$ 28, 84 g/mol and HFO1234yf $Mm_{HFO1234yf}$ 114, 06 g/mol the speed of air effusion is about double than the refrigerant, and this makes it possible to exploit in an effective way the effusion for purging more air with respect to the vapour of fluid.

In particular, for a mixture of air and gas R-134a that has a molar mass of 102, 03 g/mol, a speed of air effusion is reached 1.88 times higher than the gas.

Alternatively, as shown in FIG. 8B, the selective passage means 115 comprises a porous dividing wall 115*b*.

As described above, for increasing the effect of separation can be provided a plurality of separation chambers 64*i* adjacent to each other and separated from the selective passage means 115. This way, using at least one chamber, or chambers in series, each with pressure lower than the previous one, connected by holes of small diameter 115*a* or alternatively, by porous walls 115*b*, it is possible to achieve an effusion of the mixture through the chambers 64*i* and then to discharge from the last chamber the air mixture into the environment, obtaining an ideal purging of sole air. This technique can be applied to any mixture of refrigerant with the variable that this process is more effective the more different the molecular masses of the two gas from each other.

Figure 9:
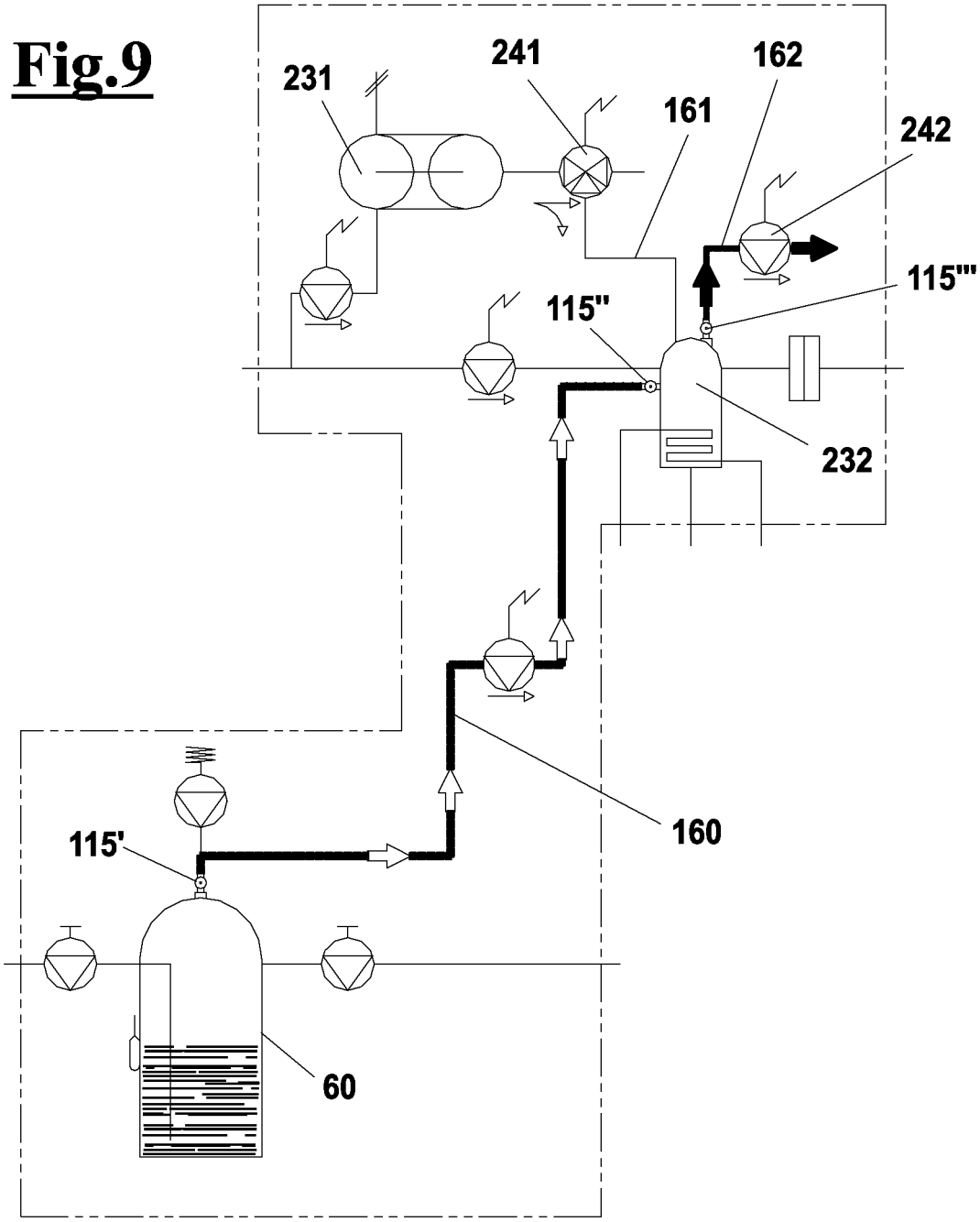
FIG. 9 shows a diagrammatical view of a second exemplary embodiment, according to the invention, of a device for purging air and gas impurities present in a storage container in a refrigerant recovery and regeneration apparatus.

Alternatively to the solutions of FIGS. 6-8 and with reference to FIG. 9, the recovery and regeneration circuit, comprising an evaporator 232, can be equipped, unlike the circuit of the prior art of FIG. 1, with a duct 160 that connects directly the storage container 60 with the evaporator 232, in such a way that the first chamber is the evaporator 232. This way, the gaseous phase 26, comprising the vapour component 26*a* of the refrigerant and the air component 26*b*, can move from the storage container 60 to the evaporator 232 through a first selective passage means 115' at the storage container 60 and a second selective passage means 115" arranged at the exit from the evaporator for being then purged into the environment.

Advantageously, along the duct a third selective passage means 115'" can be arranged at the inlet of the duct in the evaporator, in such a way that the duct works as a further separation chamber, in which a further selection is carried out of the air component 26*b* with respect to the vapour component 26*a*.

Advantageously, the recovery and regeneration circuit for the refrigerant of FIG. 9 provides:

a connection 161 from the evaporator 232 to the vacuum pump 231, comprising a solenoid three-way valve 241;

a discharge duct air 162 from the evaporator 232 to the environment that has a solenoid valve for controlling the purge;

This way, after regenerating and accumulating the refrigerant in the storage container 60, the refrigerant can be drawn by suction into the evaporator 232, by the vacuum pump 231. This permits having the storage reservoir of the recovered refrigerant 60, which has to be purged by air, connected to the evaporator 232 already at low-pressure. Furthermore, the connection 160 to the evaporator 232 permits that the mixture of gas and air to discharge in the a path of recovering the refrigerant, condition for carrying out more cycles of recovery and purging air, improving the degree of purity of the refrigerant recovered an each pass.

Advantageously, associated with the reservoir for storing the gas regenerated and with the evaporator, an automatic inspection means is provided as in the prior art. In particular, the inspection means comprises temperature probes, pressure probes, and weight probes 137, for controlling the amount of gas present in the storage reservoir before and after the purging step (FIG. 10).

Figure 10:
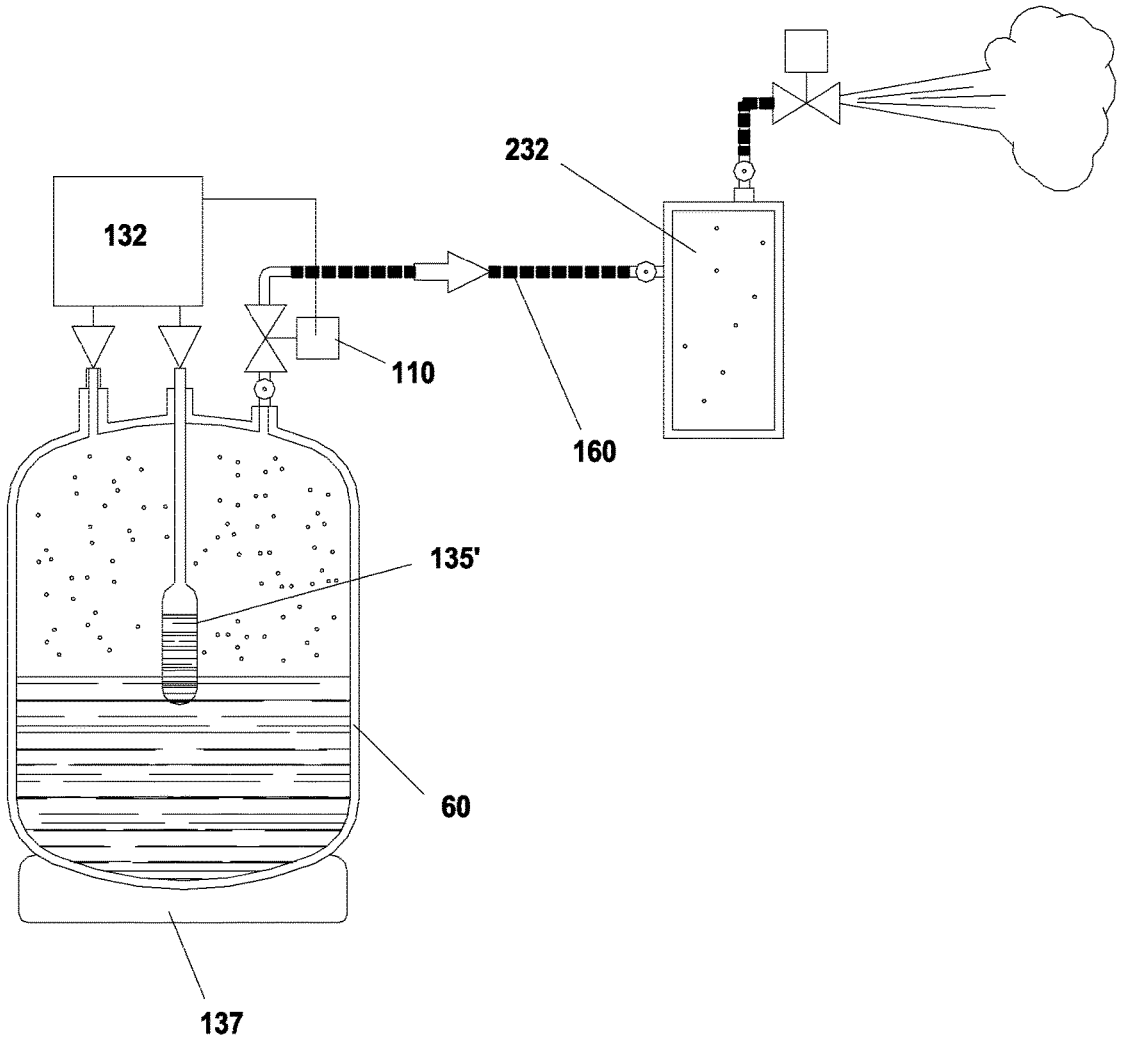
FIG. 10 shows a diagrammatical view, according to the invention, of a device for controlling automatically the operation of purging air and gas impurities present in a storage container of a refrigerant recovery and regeneration apparatus.

In particular, with reference to FIG. 10, a method that can be used for controlling the purging steps in accordance with an embodiment of this invention, provides a differential pressure switch 132 connected to the storage reservoir 60 and to the bulb of pure refrigerant 135' thermally coupled to the reservoir. With such sensors, the purge of air is carried out automatically responsive to a signal from the differential pressure switch 132 until it reaches the selected pressure, which is given by a value ΔP added to the vapour pressure measured in the reference bulb.

Figure 11:
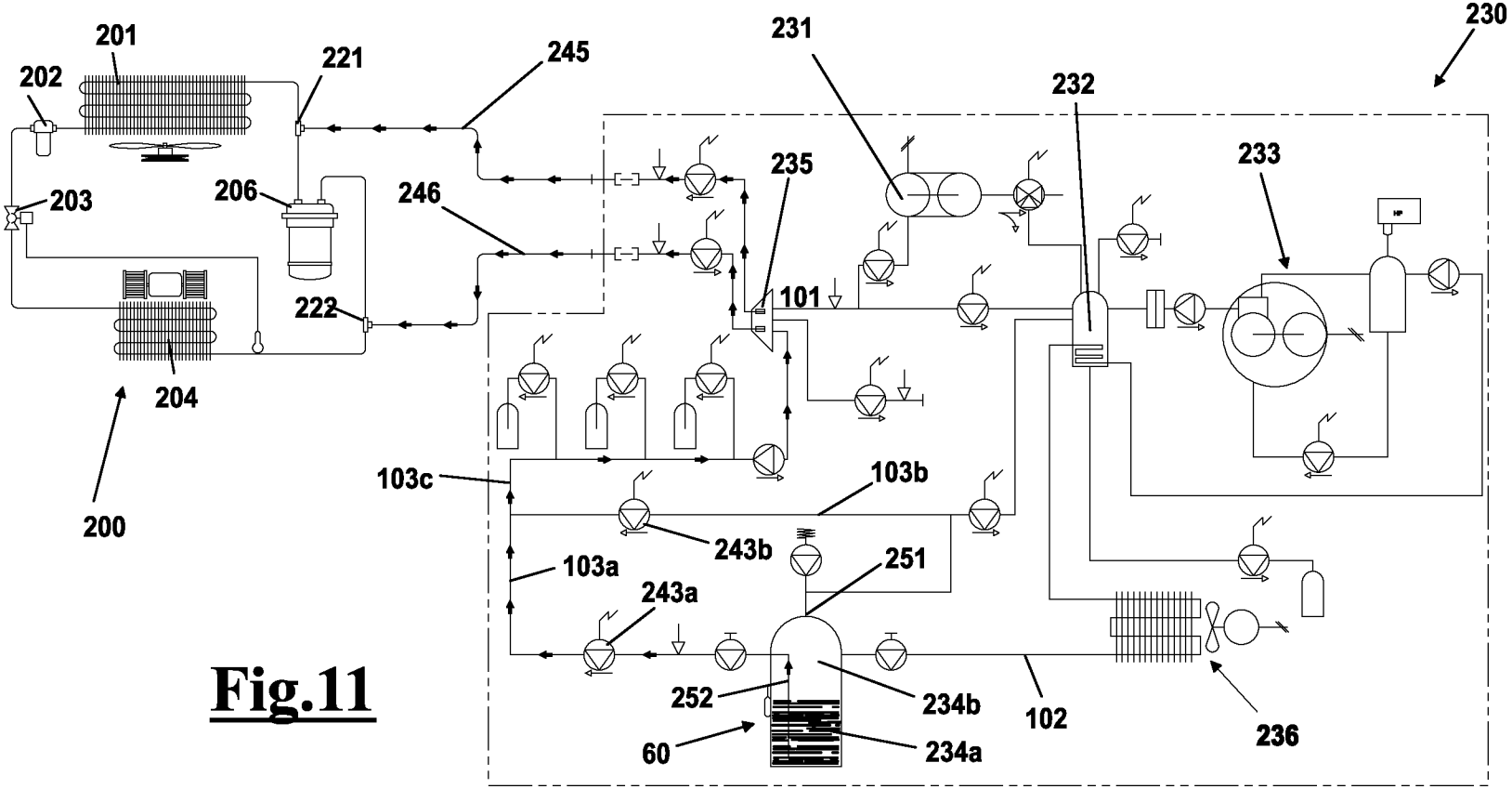
FIG. 11 shows a diagrammatical hydraulic view of a preferred exemplary embodiment of a recovery and regeneration apparatus according to the invention, during the step of conveying the refrigerant in liquid phase from the storage container to the air conditioning system.
Figure 12:
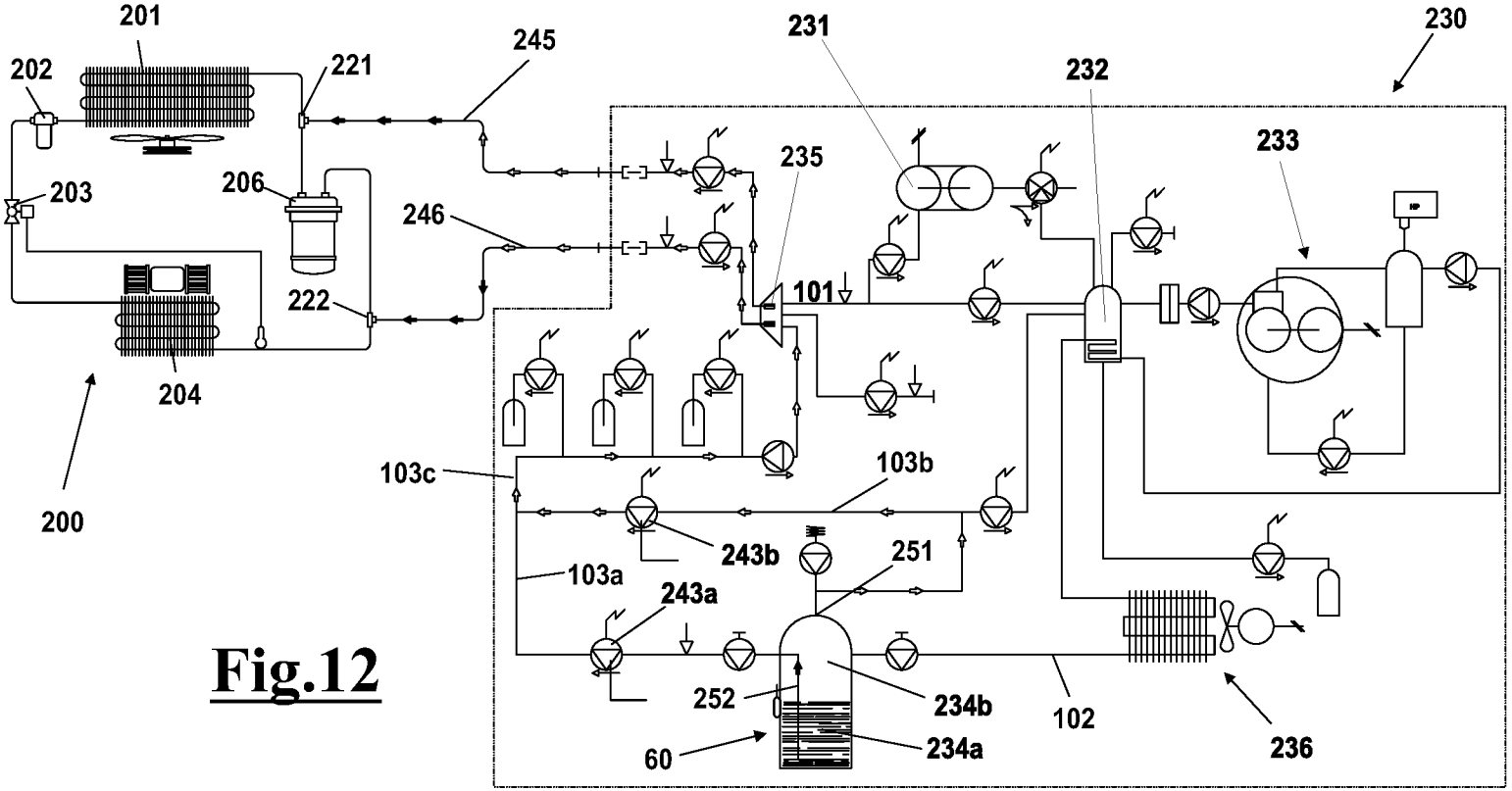
FIG. 12 shows a diagrammatical hydraulic view of a preferred exemplary embodiment of a recovery and regeneration apparatus according to the invention, while conveying the refrigerant in gaseous phase from the storage container to the air conditioning system.

With reference to FIGS. 11 and 12, an apparatus 230, according to an embodiment of the present invention, for recovering and regenerating a refrigerant, provides two ducts 103*a* and 103*b*, connected to duct 103*c*, between the storage container 60 and collector 235.

More in detail, the ducts 103*a* and 103*b* have respective valves 243*a* and 243*b* configured to be switched between an open position and a closed position for connecting hydraulically the storage container 60 to the air conditioning system or insulating them from each other.

More in detail, with reference to FIG. 11, the duct 103*a*, marked by black arrows, comprises a suction portion 252 immersed in the liquid phase of refrigerant 234*a* present in the storage container 60.

With reference to FIG. 12, duct 103*b*, marked by white arrows, comprises a connection portion 251 for connecting to the storage container 60. More in detail, the connection portion 251 connects hydraulically the upper part of the storage container 60, in which it accumulates the gaseous phase of refrigerant 234*b*, with duct 103*b*.

This way, it is possible to start the refilling step of the air conditioning system by opening, through valve 243*a*, the suction mouth of refrigerant in liquid phase from suction portion 252, and cause the refrigerant to flow through the duct 103*a* up to the air conditioning system, through outflow duct 103*c*. Once discharged from the storage container 60 a predetermined amount of refrigerant Q* in liquid phase (for example a mass lower than 5-10 g with respect to the calculated mass that should fill the air conditioning system), valve 243*a* is closed, and valve 243*b* is opened, to let a small amount of refrigerant in gaseous phase to flow through the connection portion 251 and then to flow along duct 103*b*, until it reaches outflow duct 103*c*, where the refrigerant in gaseous phase pushes towards the air conditioning system any residue fraction of the refrigerant in liquid phase, present in the duct 103*c* same and in the connection ducts 245 of connection with the air conditioning system.

Figures 13, 14:
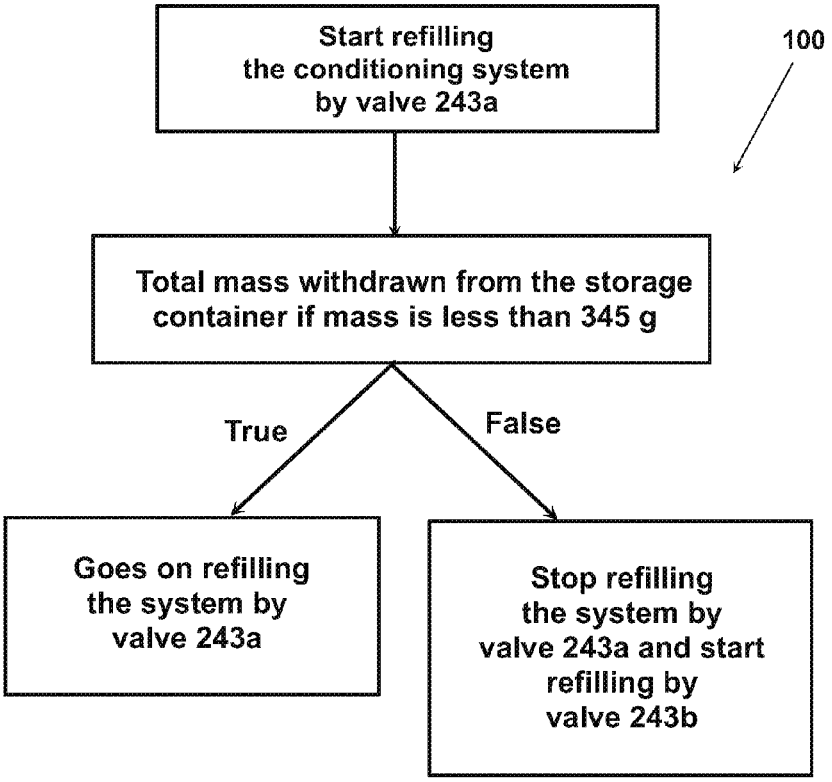
FIG. 13 shows a flow-sheet of the operations effected, during the filling step, by the apparatus according to the invention.
FIG. 14 shows a possible routine of refill for operating the valves with the method for filling, according to the invention.

Advantageously, the step above described can be automatic according to the block diagram 100 of FIG. 13, a possible implementation of which is shown in FIG. 14.

This solution allows, unlike the prior art, purging completely the refrigerant in liquid phase by ducts 245 of connection with the air conditioning system, reducing the waste of incondensable matter, and increasing the precision, fulfilling the tolerances provided by the Regulations SAE J2788 and SAE J2843, of the calculation of the refrigerant delivered to the air conditioning system.

The foregoing description of specific exemplary embodiments will so fully reveal the invention according to the conceptual point of view, so that others, by applying current knowledge, will be able to modify and/or adapt in various applications the specific exemplary embodiments without further research and without parting from the invention, and, accordingly, it is meant that such adaptations and modifications will have to be considered as equivalent to the specific embodiments. The means and the materials to realise the different functions described herein could have a different nature without, for this reason, departing from the field of the invention. It is to be understood that the phraseology or terminology that is employed herein is for the purpose of description and not of limitation.

The invention claimed is:

1. An apparatus for recovering refrigerant from an air conditioning system, said apparatus comprising:

an evaporator arranged to receive said refrigerant from said air conditioning system, and separating said refrigerant from impurities present in said refrigerant, obtaining purified refrigerant;

a compressor for circulating said purified refrigerant exiting from said evaporator;

a condenser in hydraulic connection with said compressor, said condenser arranged to condense the refrigerant exiting from said compressor;

a storage container in hydraulic connection with said condenser, said storage container arranged to contain the refrigerant condensed by said condenser, said storage container defining a storage chamber arranged to contain a liquid phase of said refrigerant and a gaseous phase comprising a vapour component of said refrigerant and an air component, and having a purge opening;

wherein said apparatus provides a purging device comprising:

a measuring device configured to measure operating parameters of said refrigerant present in said storage chamber;

a purge device arranged at said purge opening configured to purge said gaseous phase present in said storage chamber from said air component;

at least a first separation chamber connected to said storage container;

a selective passage arranged at said opening between said storage chamber and said first separation chamber arranged to separate said gaseous phase into said vapour component of fluid and into said air component, wherein, through said selective passage, only said air component and a reduced amount of said vapour component enter said first separation chamber; and wherein a duct is provided that connects said storage container with said evaporator, and wherein said first separation chamber consists of said evaporator, wherein said gaseous phase comprising said vapour component of said refrigerant and said air component passes from said storage container into said evaporator through a first selective passage at said storage container, and a second selective passage that is arranged at the outlet from said evaporator, for then being purged into the environment.

2. The apparatus according to claim 1, wherein said selective passage is arranged to divide said gaseous phase, respectively, into said vapour component of said refrigerant, and into said air component according to the Graham law, which defines that the effusion rates of two different gases through a calibrated hole are inversely proportional to the square roots of their molecular masses:

$$u_1/u_2=\sqrt{M_{m2}}/\sqrt{M_{m1}}.$$

3. The apparatus according to claim 2, wherein said selective passage comprises a dividing wall with a calibrated hole.

4. The apparatus according to claim 2, wherein said selective passage comprises a porous dividing wall.

5. The apparatus according to claim 1, wherein a plurality of separation chambers is provided that are adjacent to each other and separated by said selective passage.

6. The apparatus according to claim 1, wherein, at said duct, a third selective passage is arranged at the inlet of said duct into said evaporator, and said duct defines a further separation chamber, wherein the connection duct having said selective passage exiting from the storage chamber and said third selective passage at the entrance of the evaporator works as a further separation chamber in which a further selection is carried out of the air component with respect to the vapour component.

7. The apparatus according to claim 6, wherein said purge device comprises a valve associated with said measuring device and configured to purge said air component.

8. The apparatus according to claim 1, wherein said measuring device comprises a thermometer and a differential pressure switch connected to the storage reservoir and to a bulb of pure refrigerant thermally coupled to the reservoir, in order to drive the purge of air automatically responsive to a signal from the differential pressure switch until it reaches the selected pressure that is given by a value ΔP added to the vapour pressure detected in said bulb.

9. The apparatus according to claim 1, further comprising:

a collector arranged to hydraulically connect, by two connection ducts, a high pressure duct and a low pressure duct of said air conditioning system with a feed duct of the refrigerant in said apparatus;

a first charging duct having a first valve configured to be switched between an open position, for hydraulically connecting said storage container to said air conditioning system, and then sending said regenerated refrigerant in the liquid phase from said storage container to said air conditioning system, and a closed position, to hydraulically insulate said storage container from said air conditioning system;

a weight probe configured to measure the amount of refrigerant contained in said storage container, obtaining a determined amount of refrigerant discharged from said storage container and charged into said air conditioning system; and a second charging duct arranged parallel to said first charging duct, which is adapted to send said refrigerant in gaseous phase to said air conditioning system.

10. The apparatus according to claim 9, wherein said second charging duct is located downstream of the storage container and parallel to said first charging duct, and is adapted to send said regenerated refrigerant in the gaseous phase from said storage container to said air conditioning system.

11. The apparatus according to claim 9, wherein:

said second charging duct has a second valve configured to be switched between an open position for hydraulically connecting said storage container to said air conditioning system, and then sending said regenerated refrigerant in the gaseous phase from said storage container to said air conditioning system, and a closed position, to hydraulically insulate said storage container from said air conditioning system.

12. The apparatus according to claim 9, wherein said first charging duct provides a suction mouth close to the bottom of said storage container, arranged to ensure a suction of the sole liquid phase of the refrigerant, and said second charging duct provides a discharge mouth from said storage container, in a top position of said storage container, arranged to ensure a suction of the sole gaseous phase of the refrigerant.

13. The apparatus according to claim 9, wherein said second charging duct provides a converting device arranged for converting into the gaseous phase the refrigerant that is stored in the liquid phase.

14. The apparatus according to claim 9, wherein said second charging duct provides a pumping device for pumping refrigerant in the gaseous phase.

15. The apparatus according to claim 9, wherein said second charging duct provides a pumping device arranged to pump refrigerant in the gaseous phase.

16. A method for recovering refrigerant from an air conditioning system, comprising the steps of:

collecting said refrigerant from said air conditioning system and separating by evaporation said refrigerant from impurities present in said refrigerant, obtaining purified refrigerant, said step of collecting and separating carried out by an evaporator;

compressing said purified refrigerant exiting from said evaporator, said compressing step carried out by a compressor;

condensing said refrigerant exiting from said compressing step, said condensing step carried out by a condenser;

accumulating said refrigerant condensed by said condenser into a storage container in hydraulic connection with said condenser;

wherein said method comprises the further steps of:

prearranging at least one separation chamber connected to said storage container, and selective passage arranged to connect said storage container and said separation chamber;

separating said gaseous phase into said vapour component of said refrigerant and said air component, so that only said air component and a reduced amount of vapour component move through said selective passage and reach said separation chamber; and providing a duct that connects said storage container with said evaporator, and wherein said separation chamber consists of said evaporator, so that said gaseous phase comprising said vapour component of said refrigerant and said air component passes from said storage container into said evaporator through a first selective passage at said storage container and a second selective passage that is arranged at the outlet from said evaporator, for then being purged into the environment.

17. An apparatus for recovering refrigerant from an air conditioning system, said apparatus comprising:

a collector arranged to hydraulically connect, by two connection ducts, a high pressure duct and a low pressure duct of said air conditioning system with a feed duct of the refrigerant in said apparatus;

an evaporator arranged to separate said refrigerant from impurities which are present in said refrigerant, through an evaporation of residue liquid fractions of said refrigerant, obtaining a purified refrigerant that rises to the high part of the evaporator and of impurities that are concentrated at the bottom of said evaporator;

a compressor for circulating said purified refrigerant exiting from said evaporator, said compressor being in hydraulic connection with said feed duct through said evaporator;

a condenser in hydraulic connection with said compressor, said condenser arranged to condense the refrigerant exiting from said compressor;

a storage container in hydraulic connection with said condenser, said storage container arranged to contain the refrigerant condensed by said condenser;

a first charging duct having a first valve configured to be switched between an open position, for hydraulically connecting said storage container to said air conditioning system, and then sending said regenerated refrigerant in the liquid phase from said storage container to said air conditioning system, and a closed position, to hydraulically insulate said storage container from said air conditioning system;

a weight probe configured to measure the amount of refrigerant contained in said storage container, obtaining a determined amount of refrigerant discharged from said storage container and charged into said air conditioning system; and wherein a second charging duct, arranged parallel to said first charging duct is provided, which is adapted to send said refrigerant in the gaseous phase to said air conditioning system.

18. The apparatus according to claim 17, wherein said second charging duct is located downstream of the storage container and parallel to said first charging duct, and is arranged to send said regenerated refrigerant in the gaseous phase from said storage container to said air conditioning system.

19. The apparatus according to claim 17, wherein:

said second charging duct has a second valve configured to be switched between an open position, for hydraulically connecting said storage container to said air conditioning system, and then sending said regenerated refrigerant in the gaseous phase from said storage container to said air conditioning system, and a closed position, to hydraulically insulate said storage container from said air conditioning system.

20. The apparatus according to claim 17, wherein said first charging duct provides a suction mouth close to the bottom of said storage container, arranged to ensure a suction of the sole liquid phase of the refrigerant, and said second charging duct provides a discharge mouth from said storage container, in a top position of said storage container, in order to ensure a suction of the sole gaseous phase of the refrigerant.

21. The apparatus according to claim 17, wherein said second charging duct provides a converting device arranged to convert into the gaseous phase the refrigerant that is stored in the liquid phase.

* * * * *